US012590382B2

(12) United States Patent
Sarsanedas Gimpera et al.

(10) Patent No.: US 12,590,382 B2
(45) Date of Patent: Mar. 31, 2026

(54) ELECTROLYTIC MEDIUM, ELECTROPOLISHING PROCESS USING SUCH ELECTROLYTIC MEDIUM AND DEVICE TO CARRY IT OUT

(71) Applicant: DRYLYTE, S.L., Barcelona (ES)

(72) Inventors: Marc Sarsanedas Gimpera, Barcelona (ES); Pau Romagosa Calatayud, Barcelona (ES); Miguel Francisco Perez Planas, Barcelona (ES); Joan David Gutierrez Castillo, Barcelona (ES); Marc Soto Hernandez, Barcelona (ES)

(73) Assignee: DRYLYTE, S.L., Barcelona (ES)

( * ) Notice: Subject to any disclaimer, the term of this patent is extended or adjusted under 35 U.S.C. 154(b) by 504 days.

(21) Appl. No.: 18/266,376

(22) PCT Filed: Nov. 30, 2021

(86) PCT No.: PCT/ES2021/070864
§ 371 (c)(1),
(2) Date: Jun. 9, 2023

(87) PCT Pub. No.: WO2022/123096
PCT Pub. Date: Jun. 16, 2022

(65) Prior Publication Data

US 2024/0102197 A1 Mar. 28, 2024

(30) Foreign Application Priority Data

Dec. 9, 2020 (EP) ..... 20383069

(51) Int. Cl.
*C25F 3/16* (2006.01)
*C25F 7/00* (2006.01)

(52) U.S. Cl.
CPC . *C25F 3/16* (2013.01); *C25F 7/00* (2013.01)

(58) Field of Classification Search
None
See application file for complete search history.

(56) References Cited

U.S. PATENT DOCUMENTS 3,533,928 A 10/1970 Inoue
3,637,473 A 1/1972 Greenspan et al.
3,776,827 A 12/1973 Inoue
(Continued)

FOREIGN PATENT DOCUMENTS

EP 3372711 A1 9/2018
ES 2604830 A1 3/2017
(Continued)

OTHER PUBLICATIONS

"Journal of Chromatography, Including Electrophoresis and Other Separation Methods", vol. 602, Nos. 1 &2, Jun. 5, 1992, pp. 1-150.
(Continued)

*Primary Examiner* — Brian W Cohen
(74) *Attorney, Agent, or Firm* — Edell, Shapiro & Finnan, LLC

(57) ABSTRACT

An electrolytic medium is provided to the treatment of metallic surfaces and includes solid particles and a non-conductive fluid, the process that uses said medium and the device to carry out the process.

27 Claims, 3 Drawing Sheets

(56) References Cited

U.S. PATENT DOCUMENTS

| | | | | |
|---|---|---|---|---|
| 4,522,692 | A | 6/1985 | Joslin | |
| 10,344,393 | B2 | 7/2019 | Sarsanedas Millet et al. | |
| 2021/0122941 | A1* | 4/2021 | Sarsanedas Millet ... | C09G 1/16 |
| 2022/0161382 | A1* | 5/2022 | Soto Hernandez ..... | C25F 3/22 |
| 2022/0372648 | A1* | 11/2022 | Soto Hernandez ..... | C09G 1/02 |

FOREIGN PATENT DOCUMENTS

| | | | |
|---|---|---|---|
| ES | 2721170 | A1 | 7/2019 |
| ES | 2734415 | A1 | 12/2019 |
| ES | 2734500 | A1 | 12/2019 |
| ES | 2754876 | A1 | 4/2020 |
| ES | 2756948 | A1 | 4/2020 |
| GB | 1406081 | A | 9/1975 |
| WO | 99/10569 | A1 | 3/1999 |

OTHER PUBLICATIONS

"Journal of Chromatography, Including Electrophoresis and Other Separation Methods", vol. 602, Nos. 1 &2, Jun. 5, 1992, pp. 151-294.

Int'l Search Report for PCT/ES2021/070864, dated May 10, 2022.

* cited by examiner

ELECTROLYTIC MEDIUM, ELECTROPOLISHING PROCESS USING SUCH ELECTROLYTIC MEDIUM AND DEVICE TO CARRY IT OUT

FIELD OF THE INVENTION

This invention is part of the industry sector dedicated to the treatment of metal surfaces. Especially in the area of metal smoothing, burnishing and polishing.

BACKGROUND

In 2016, a new technology for polishing metal surfaces based on an electrochemical process using a solid electrolyte described in the patent document under publication number ES2604830 was released. By using a novel solid electrolyte, this process substantially improved the conventional liquid electropolishing process. From a practical point of view, the use of corrosive concentrated acid solutions is avoided and no liquid waste is generated. On the other, the results obtained surpass those expected from a conventional electropolishing process, since solid bodies free of solid electrolyte increase selectivity by concentrating the electrochemical effect on the roughness peaks.

In general, the solid electrolyte for this electropolishing process is composed of an ion exchange resin that retains a liquid electrolyte. Several documents describe different compositions of these solid electrolytes to carry out this process.

Document ES2604830 describes an electropolishing process with solid electrolyte by ion transport, and a solid electrolyte in which the retained liquid electrolyte includes hydrofluoric acid.

Document ES2721170 describes a solid electrolyte in which the retained electrolyte is a sulfuric acid solution. This electrolyte is described as especially useful for stainless steels and cobalt chromium alloys.

Document ES2734500 describes a solid electrolyte in which the retained electrolyte is a hydrochloric acid solution as a solution to the specific problem posed by polishing titanium.

Document ES2734415 describes a solid electrolyte containing a solution of sulfonic acid, preferably methanesulfonic acid. This composition is useful for a wide range of alloys and metals.

In all the cases described, these are formulations that are based on two elements: on the one hand, a set of non-conductive inert support particles, and on the other hand, an aqueous solution of strong acid.

However, these compositions have a number of limitations:

- When the lowest levels of roughness that the system reaches are reached, a characteristic ripple is generated, commonly called "orange peel".
- The particles generate acid exudates on the metal surface that often cause pitting.
- The acid exudates, together with atmospheric oxygen, oxidize the surface in an uncontrolled way.
- The final roughness cannot be reduced beyond a limit, which depends on the PIECE (initial roughness, metal, shape, etc.) and the solid electrolyte (size, composition, concentration, etc.)
- The evaporation of the contained electrolyte liquid generates a drift of results in the process.
- The high mechanical resistance of the medium prevents delicate pieces from being polished.

More or less obvious solutions to these limitations for a person skilled in the art include varying the electrical parameters used in the process, reducing the concentration of the acidic solution that is included in the solid electrolyte, or reducing the amount of aqueous solution. This may produce a certain improvement in some of the problems, but it does not represent any qualitative leap.

DESCRIPTION OF THE INVENTION

This invention discloses a new electrolytic medium, an electropolishing process that uses it, as well as devices to carry out this process.

The fundamental difference of this invention is the presence of a non-conductive fluid together with solid electrolyte particles. Counterintuitively, this has advantages in a solid electrolyte electropolishing process discussed below.

Thus, one aspect of the invention refers to an electrolytic medium comprising:

- Set of solid electrolyte particles that comprise solid particles that retain a conductive solution, and
- A non-conductive fluid that is not miscible in the conductive solution.

In the present invention, the term "set of solid electrolyte particles" refers to the set formed by the solid particles and the conductive solution.

In this text the electrolytic medium of this aspect of the invention will be referred to as the electrolytic medium of the invention.

In this text fluid is understood in a broad sense, materials with very high viscosities are considered fluids, such as petroleum jelly, with a viscosity at room temperature close to 0.05 $m^2/s$. Both Newtonian and non-Newtonian fluids are considered within the scope of this invention.

In this text, it is understood that two fluids are not miscible or are immiscible in the event that they do not form a single phase in any proportion between them within the working temperature range of the process, as a reference, from 0 to 100° C.

A second aspect of the invention relates to the use of the electrolytic medium of the invention in an electropolishing process.

Another aspect of the invention refers to an electropolishing process comprising the steps of:

- connecting at least one piece to be polished to a power source;
- connecting at least one electrode to the opposite pole of the power supply;
- contacting the piece to be polished and the solid electrolyte particles of the electrolytic medium defined in the invention with a relative movement between the piece and the particles;
- applying a potential difference between the piece to be polished and the electrode, which produces a current flow between them through the electrolytic medium defined in the present invention.

Relative movement is understood as that movement that changes the relative position of two points. This includes oscillating or vibrating movement between two points, such as movement that occurs between a vibrating surface and a particle.

A final aspect of the invention refers to a electropolishing device comprising:

- a power supply;
- an electrode that transmits the electrical charge from the power supply to the electrolytic medium;

means for generating relative movement between at least one metal piece to be polished and an electrolytic medium according to the invention, wherein the means for generating relative movement are selected from:

means for blasting the electrolytic medium on the piece, connected to the power supply, and a container with the electrolytic medium, and a system that provides the piece with electrical connectivity and movement.

Technical Effect

The addition of a non-conductive fluid to a set of solid electrolyte particles improves the results of the electrochemical process for solid electrolyte polishing of metals.

In solid electrolyte electropolishing processes prior to this invention, a metal piece to be polished connected to one electrode is introduced into a medium of solid electrolyte particles that also contain a second electrode. The difference in potential applied between the electrodes causes redox reactions at the particle-metal contact points (metal roughness peaks). These metal oxides are eliminated by the particles in the form of cations, producing a polishing effect. Solid electrolyte particles conduct electricity through the contact areas between them. When the particles contact the metal surface, due to pressure, they leave acid exudates on the surface.

The solid electrolyte described in this invention includes a non-conductive fluid immiscible in the electrolyte liquid that the particles contain. This fluid has surprising effects on the connectivity between the particles, as well as on the particle-metal surface interaction.

Effect Among Particles

Without the non-conductive liquid, each particle has a part of its surface that contacts other particles and another part that contacts the gaseous medium (usually air). In contrast, in this invention, the non-conductive fluid contacts the surface of the spherical particles, without significantly penetrating the interior, avoiding the areas where the particle contacts another particle.

In the particle-particle contact areas, the liquid electrolyte in the particles is concentrated. The immiscibility between the two fluids (conductive and non-conductive) makes the particle-particle conductive liquid menisci more concentrated in space, and therefore stronger. All of this translates into greater particle connectivity.

Effect on the Surface to be Polished

During an electropolishing process with this invention, the metal surface is covered with non-conductive fluid, except at the particle-metal contact points. This has several positive effects on the final finishes:

Protects from localized acid attacks. As the surface is covered with immiscible liquid, the aqueous acidic exudates of the particles do not accumulate on the metal surface, which prevents pitting.

Prevents atmospheric oxidation, by preventing the contact of ambient oxygen with the metal.

As the oxidation of the metal is due exclusively to the contact of the particles and the passage of electric current, the control over the electrochemical process is increased.

It concentrates the electrochemical action where it is most effective, in the roughness peaks. If we visualize the surface roughness as a succession of peaks and valleys, the non-conductive fluid leaves the valleys inactive against the electrochemical process.

Lower final roughness and ripple. As the fluid is preferentially distributed in the valleys, the process is able to better discern roughness and achieve smoother finishes.

Reduction of the final "orange peel".

More selective process: less metal removed to achieve the same roughness reduction.

Solid electrolyte particles by themselves behave like a granular material. The fact that the solid electrolyte can be formulated with a non-conductive fluid allows the assembly to be treated as a fluid in certain formulations, which allows the polishing process to be carried out by immersion, but also by blasting the set on the piece to be polished.

Thus, this invention describes: an electrolytic medium that comprises a non-conductive fluid and a set of solid electrolyte particles, comprised of particles that retain a conductive solution, wherein the non-conductive fluid and the conductive solution are not miscible.

DETAILED DESCRIPTION OF THE INVENTION

Figure 1:
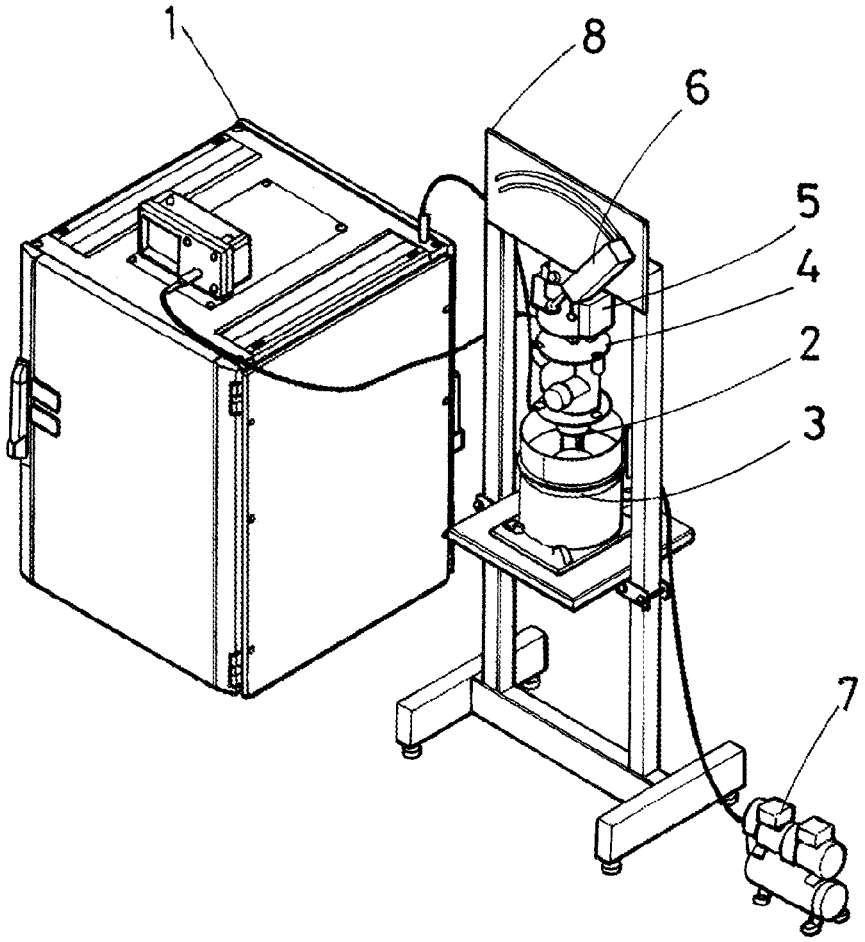
FIG. 1 shows an exemplary diagram of an electropolishing device of the invention by immersion.

A fundamental aspect of the invention refers to an electrolytic medium formed by a "set of solid electrolyte particles with non-conductive fluid" for electropolishing that comprises:

A set of solid electrolyte particles, comprising solid particles that retain a conductive solution;

A non-conductive fluid that is not miscible in the conductive solution.

Solid Electrolyte Particles

Solid electrolyte particles are composed of solid particles that have the ability to retain a conductive liquid solution so that this gives them conductivity. The set of electrolyte solid particle, conductive liquid solution, presents an electrical conductivity greater than 10 micronS/cm. Liquid retention can occur due to porosity of the material or due to molecular structure such as a gel-like structure. Preferably the particles are porous, this porosity is selected from: microporosity, mesoporosity, macroporosity and fractal porosity. The retention mechanisms can be: permeation, absorption, adsorption, retention in the interlaminar space.

These particles can be of any material that is capable of retaining liquid, such as, for example, mineral, ceramic, polymeric materials, organic compounds, inorganic compounds, of plant origin.

These particles are preferably made of polymeric material.

Preferably the particles are spheres or spheroids.

Preferably, the particles have a liquid retention capacity of between 1% and 80% by mass of water with respect to the total mass, which is the mass of particles plus the mass of water.

In this text, the % express mass ratios of component X with respect to the total referenced mass.

Polymeric Material

These solid particles capable of retaining liquid are preferably made of polymeric material, since it is a material with a lower hardness than that of metals, so the process does not have an abrasive component. As they must flow through the metal surface, they have a shape that favors their movement over the surface to be polished. Because of that, the preferred shape of the polymeric material particles is a spherical or spheroid shape.

The initial roughness $R_a$ to be reduced is usually between 1 and 10 micrometers, so that the spheres can roll over the roughness, without polishing it, preferably the particle sizes have a very high sphere-roughness ratio (large spheres in relation to the roughness). Therefore, the optimum mean diameter of the particles is preferably between 100 microns and 1 millimeter.

The preferred polymeric materials are ion exchange resins selected from: strong and weakly acidic cationic resins, strong and weakly basic anion exchange resins and chelating resins. More preferably, cationic exchange resins, since in this way they have the capacity to capture the metal ions extracted in the electropolishing processes.

In particular, the particles of polymeric material are made of a sulfonated divinylbenzene S-DVB and styrene copolymer, since it is a material resistant to acid and the oxidative action of the process. It has the ability to act as an ion exchanger, which favors the extraction of metal from the surface to be polished by storing the ions.

Alternatively, the polymeric material particles are of a copolymer containing units derived from acrylic acid or methacrylic acid. This includes derivatives with different functional groups such as acrylic acid, acrylamide, cyanoacrylate, alkyl acrylates, among others, and the corresponding methacrylate analogs. The particles based on these materials have a high elasticity which is suitable for processing parts having open geometries without cavities.

The particles can have a porous structure, which facilitates the exchange of fluids resulting in a faster process.

Alternatively the particles may have a gel-like structure. In this case the fluid exchange is more restricted, which results in a slower process, however, the particle-surface contact is more defined, resulting in a lower final roughness.

Preferably, the polymeric material particles include functional groups that are capable of capturing or retaining the metal ions generated during the process, such as acid, amino, or chelating groups.

These functional groups can be of the acidic type, such as sulfonic or carboxylic groups. These acidic functional groups are especially useful in this application as they have good chemical resistance and are capable of retaining a wide variety of metal ions.

It is also possible to use functional groups that are of the chelating type such as, for example, iminodiacetic, aminophosphonic, polyamine, 2-picolylamine, thiourea, amidoxime, isothiouronium, bispicolilamine, among others. These chelating groups have a high selectivity over the transition metals versus alkali or alkaline earth metals, which allows them to be more flexible in the formulation and does not require the use of distilled water.

Conveniently, various commercial ion exchange resins meet the required characteristics to be used as polymeric material particles.

Conductive Solution

The conductive liquid solution that is retained in the particles is a conductive liquid. The function of the conductive liquid solution in an electropolishing process is twofold: on the one hand, it conducts electricity, and on the other, it must be able to dissolve the oxides that are formed on the surface to be treated. For this reason, the composition of this liquid is key and depends on the process to which it is to be applied, on the type of surface to be treated. For electropolishing processes the conductive liquid solution can be an ionic liquid, a liquid acid, a conductive solution, a conductive liquid polymer.

The conductive solution can include a polar solvent such as, for example, without limitation, water, ethanol, isopropanol, DMSO, DMF, ionic liquids, among others. Preferably, the conductive solution includes water, as it is a solvent that is capable of effectively dissolving salts and metal oxides.

Even more preferably, the conductive solution contains at least one acid, for example an aqueous solution comprising an acid. This has the technical effect of increasing conductivity by increasing the number of protons (which are highly conductive) in the medium, and simultaneously increasing the solubility of metal oxides, which are mostly acidic. For example, without the purpose of limitation, the acids that can be used are sulfuric acid, sulfonic acids, phosphoric acid, carboxylic acids, citric acid, hydrochloric acid, hydrofluoric acid. A preferred acid to use is sulfuric acid, as it is a strong non-volatile acid.

A family of acids being preferably used are the sulfonic acids, due to their high acidity and the solubility of their salts. Preferably, the sulfonic acid used is methanesulfonic acid, since it is the one with the highest solubility of its salts.

Phosphoric acid is also preferred in cases of metals highly sensitive to corrosion, since it facilitates the formation of passive layers of protective metal phosphate.

A highly active acid being preferably used and with a high attack rate is hydrochloric acid.

Acids can be used alone or in combination of several of them. A preferred combination is the combination of strong acids with phosphoric acid.

Acids can be combined with complexing agents, salts, etc. to improve the conductivity of the particles and the solubility of oxides and salts.

The total concentration by mass of the acids in the conductive solution is in the range of 0.1 to 70% by mass with respect to the total mass of the water plus the acid. Preferably 1% to 40% by mass of acid relative to the mass of water plus acid. It is a very wide range due to the great difference in the chemical properties of metals. The lower range is used for metals that are highly sensitive to acid attack. The upper range is similar to the concentrations used in conventional electropolishing.

For example, to polish steels and iron-based alloys, preferably an acid concentration between 1% and 10% by mass relative to the mass of more acidic water is used, since this provides high conductivity and a dissolution of enough oxides. On the other hand, to polish titanium, preferably an acid concentration by mass between 20% and 35% with respect to the total mass of water plus acid is used, since the titanium oxides formed require a higher concentration to be dissolved.

The conductive solution can include a complexing agent such as ETDA, citrate/citric acid, polyethylene glycols, polyethers, polyamines, among others.

Citric acid or citrate is useful in the process due to its chelating effect, which is effective in removing oxides and salts from the surface to be polished.

The conductive liquid solution can also be neutral. In this case it must include dissolved ions to increase conductivity.

The conductive liquid solution can also be basic. The use of amines as a base favors the solution of metals due to their ability to coordinate with metal cations. These basic conductive solution formulations are especially suitable for metals that form anionic complexes.

Other compounds can be added to the conductive liquid solution. It is possible to add salts that increase the conductivity of the liquid, such as alkali metal salts.

The conductive solution ratio between the set of solid electrolyte particles is preferably between 25% and 60% by mass/total mass, the total mass being the mass of the conductive solution and the electrolyte particles, since in this range there is enough conductive liquid to observe measurable conductivity of the solid electrolyte particles, without observing conductive liquid free of solid electrolyte particles. More preferably, it is between 35% and 50% by mass electrolyte particles/total mass, the total mass being the mass of the conductive solution and the electrolyte particles.

In this text, free liquid or free fluid is understood as that which separates itself from the solid part under normal conditions of pressure and temperature. Normal conditions imply that the pressure is 1 atm and the temperature is 0° C. It can be determined, for example, by the "Method 9095 (Paint Filter Liquids Test)" described by the U.S. Environmental Protection Agency in publication SW-846.

Preferably, when the material of the particles is ion exchange resin based on a copolymer of styrene and sulfonated divinylbenzene, a ratio between the conductive solution and the set of solid electrolyte particles of between 34% and 52% by mass/mass total provides an optimal electropolishing process.

Non-Conductive Fluid

Non-conductive fluid is a defining element of this invention. It is a fluid that when being at rest at room temperature does not significantly conduct electrical current. To fulfill its function it must be immiscible in the liquid electrolyte contained in the solid electrolyte particles. In this way, by affinity the liquid electrolyte is kept inside the particles and the non-conductive fluid outside. As it must withstand the presence of an electrolyte liquid that can be an acid solution, in addition to considerable voltages, the non-conductive fluid must be a compound being stable or kinetically stable under working conditions.

The non-conductive fluid occupies interstitial space between the particles, either in part, totally or in excess.

The non-conductive fluid is at a concentration between 1% and 80% based on mass relative to the total mass represented by the mass of the solid electrolyte particles plus non-conductive fluid.

An advantage of this electrolytic medium is that as the surface area of electrolyte liquid exposed to air is reduced, the evaporation of electrolyte liquid is also reduced, which increases the stability of the process, achieving more reproducible results between new electrolytes and with several hours of use.

On the surface of the sphere, the conductive liquid is concentrated at the points of contact with the other spheres, generating stronger menisci that produce higher connectivity between the particles.

A main effect of the non-conductive fluid on the solid electrolyte particles is to cover the metal surface of the piece to be polished with non-conductive liquid. This has several technical effects that result in a better finish of the solid electrolyte electropolishing process:

Metal protection against localized acid attacks
Reduction of atmospheric oxidation
Greater control over the electrochemical process
Higher selectivity in the peaks
Final finish with lower roughness Viscosity The process can be carried out with very high viscosity fluids, such as petroleum jelly, which has a viscosity close to 0.05 $m^2/s$. In these cases, a system with high interparticle cohesiveness is generated. In addition, a high-viscosity coating of the piece is also produced that efficiently protects the surface from atmospheric oxidation and acid residues, making it suitable for very sensitive metals, such as carbon steels.

In most cases, it is interesting to have a homogeneous layer of non-conductive fluid that separates when the particle contacts the surface, and that recovers quickly when the particle leaves. To achieve this distribution of the non-conductive fluid on the surface to be polished, the non-conductive fluid preferably has a viscosity in the range between $1\cdot10^{-7}$ and $1\cdot10^{-4}$ $m^2/s$, such as, for example, hydrocarbons without $C_6$-$C_{16}$ functional groups, low viscosity silicone oils, among others.

Thus, the viscosity range of the non-conductive fluid is very wide, from $1\cdot10^{-7}$ to 0.05 $m^2/s$, preferably centered in the range $1\cdot10^{-7}$ and $1\cdot10^{-4}$ $m^2/s$.

Volatility

The non-conductive fluid may have a certain volatility, in this case it must be replaced periodically to maintain its properties. To avoid this process, it is preferable that the non-conductive fluid is not very volatile. Preferably the fluid has a boiling temperature greater than 100° C., for example in the range of 100 to 1000° C.

Types

There is a limited number of types of non-conductive fluids that meet the characteristics of volatility, viscosity, toxicity, etc. that make them viable for use in this application: hydrocarbons, organic solvents, essential oils, silicone and silicone oils, fluorinated solvents, among others. They can be used pure or in combination with each other.

Hydrocarbons

Hydrocarbon-based fluids are used in a wide variety of applications, such as lubricants, fuels, solvents, etc. In this text, hydrocarbons are understood as those compounds that include only carbon and hydrogen in their structure. Due to this great variety of existing hydrocarbons, those that present the properties that best suit the needs can be selected.

Aliphatic hydrocarbons are preferably used since, in general, they have less toxicity than aromatic hydrocarbons, and greater electrochemical stability.

Preferably, aliphatic hydrocarbons are used with a molecular weight and structure that allows them to be in a fluid or semi-fluid state at the working temperature, which places the potential candidates in the $C_5$-$C_{30}$ range.

Preferably hydrocarbons are used in the $C_6$-$C_{16}$ range with a linear structure, since they have very low viscosities, even below $5\cdot10^{-6}$ $m^2/s$ while they have high volatility, above 80° C.

Low volatility water immiscible solvents and organic compounds can also be used in this process, for example aliphatic alcohols like 1-octanol, organic carbonates like propylene carbonate, ethylene carbonate, among others.

Silicones

Silicones and silicone oils have various applications in relation to protection and lubrication of metal parts, so they have been optimized for their interaction with different metal surfaces as lubricants and other uses. In this text, silicones or silicone oils are understood to be those oligomers, polymers, cycles or other structures that include O—Si bonds in their main chain.

These liquids have useful characteristics for this invention. Silicone oils that include dimethylsiloxane units —OSi $(Me_2)$-. Those with a linear structure are especially useful due to their low viscosities, as well as cyclic ones such as hexamethylcyclotrisiloxane. In general, polydimethylsiloxanes are good candidates for the process and have a good variety, allowing the non-conductive fluid to be tailored to the application.

Fluorinated

Another family of solvents that provide high-quality results are fluorinated and perfluorinated fluids. In this text, fluorinated solvent is understood as one that incorporates at least one fluorine atom in its chemical structure.

These liquids are among those with the lowest surface energy, so their interaction with the particles and with the metallic surface is very weak. This has the advantage of not blocking the metal surface, but the disadvantage of having a less marked effect than other families of liquids. That is why this family of liquid is indicated to reduce orange peel.

Fluorinated solvents have a much lower surface tension than other liquids. This is due to fluorine's high electronegativity together with its poor polarizability.

Emulsions

Non-conductive fluids based on emulsified systems deserve a special mention. These systems have a high erosion speed, high fluidity that facilitates pumping, and also provide high quality finishes. An additional advantage is the possibility to more easily adapt the formula to different needs.

These emulsions are expressly a non-conductive non-polar continuous phase containing conductive polar solution micelles. According to the terminology commonly used in emulsions, we are talking about water-in-oil type emulsions (w/o). The conductive polar solution of micelles has the same composition as the conductive solution that is retained by the solid electrolyte particles. As the non-polar continuous phase is non-conductive, the emulsion at rest without solid electrolyte particles is non-conductive.

Although the emulsion is not conductive, the conductivity of the total mixture of the electrolytic medium, emulsion plus solid electrolyte particles, is clearly superior to formulations with non-emulsified fluids. This is due to the fact that the micelles of the emulsion are structured around the particles, which retain polar conductive solution, locally destabilizing the micelles, thus increasing the hydrophilic bridges between particles.

On the metal surface, the micelles absorb the remains of the polar solution (which may contain acid depending on the formulation), which reduces preferential attack points, which would turn into pitting.

An emulsion-based non-conductive fluid comprises:

A non-conductive fluid as an non-polar continuous phase based on any of the non-conductive fluids mentioned in this text.

A conductive solution as a dispersed polar phase

Surfactants to stabilize the emulsion

Preferably, the mass percentages of the non-conducting fluid are relative to the total mass of the non-conducting fluid: the sum of the non-polar continuous phase, dispersed polar phase and surfactants. The continuous non-polar phase is in a range between 50% and 99%, the dispersed polar phase in a range between 1% and 50% and the surfactants in a range between 0.01% and 30%. More preferably the non-polar phase continues between 70% and 80%, the dispersed polar phase between 20% and 30%, and the surfactant between 1.5% and 3%.

Even more preferably the surfactant is a mixture of nonionic surfactant and anionic surfactant so that the nonionic surfactant is in a range between 0% and 20% more preferably between 1% and 2%, the anionic surfactant between 0% and 10% more preferably between 0.5% and 1% and always the sum of the surfactants is at least 0.01%.

To promote the geometric effect of surface-particle interaction, preferably, the conductivity of the liquid emulsion is lower than the conductivity of the solid electrolyte particles. When an emulsion of this type is combined with a set of conductive particles, the micelles of the dispersed polar phase interact with the conductive bridges that are established between the particles, contributing to the overall conductivity. By adjusting the quantity and stability of the micelles of the dispersed polar phase through the formulation and the surfactants, the overall conductivity and the effect of the electrolytic medium in the process and on the surface to be treated are adjusted.

Preferably the continuous non-polar phase can be composed of non-polar liquids such as, for example, without limitation, hydrocarbons, organic solvents, liquid polymers, fluorinated solvents, silicones, mineral oils, vegetable oils, etc. Preferably, the continuous non-polar phase comprises hydrocarbons within the $C_5$-$C_2$ fraction since they meet the required technical characteristics of viscosity and volatility.

Preferably, the continuous non-polar phase is selected from a hydrocarbon, silicone and their mixture, the mixture comprises a hydrocarbon and a silicone with a mass percentage between 80% and 99% of hydrocarbon with respect to the total mass represented by mass of hydrocarbon plus silicone mass.

In liquid emulsion, the dispersed polar phase is made up of colloids, micelles, microdroplets, etc. scattered in the continuous non-polar phase. The dispersed polar phase is miscible with the conductive liquid solution retained in the particles. For this reason, the dispersed polar phase interacts with the conductive liquid bridges between the solid electrolyte particles, regulating the conductivity of the medium.

Preferably the dispersed polar phase is a mixture of water and an acid where water represents a percentage by mass between 30% and 99.9% with respect to the total mass water and acid, more preferably a percentage by mass between 90% and 98%.

Formulations that allow the dispersed polar phase to interact with conductive liquid bridges have a higher conductivity. These formulations preferably include a high hydrophilic or HLB (Lipophilic hydrophilic balance) surfactant, i.e. preferably with ionic or strongly polar groups, with a relatively small non-polar chain.

Formulations that stabilize the dispersed polar phase within the continuous non-polar phase have a lower conductivity. These formulations preferably include surfactants that stabilize the dispersed polar phase in the continuous non-polar phase. These surfactants preferably have a relatively low HLB, with non-ionized polar groups and one or more large non-polar chains. Although the conductivity is lower, conductive liquid bridges are more stabilized than without emulsion, which keeps the conductivity more constant when there is movement.

In this text the term surfactant is used in the broad sense to encompass all those surfactants, detergents, emulsifiers, emulsifying agent, humectants, soaps, solubilizers, softeners, surfactants, antifoams, among others, that reduce the surface tension between two phases, and that mostly have a chemical structure with polar part and non-polar part. A parameter that defines a surfactant is its hydrophilic-lipophilic balance or HLB (Hydrophilic-Lipophilic Balance). High HLB corresponds to surfactants more soluble in polar phases, while low HLB corresponds to more soluble surfactants in non-polar phases.

In this invention, the surfactant or mixture of surfactants used are key to defining the structure of the emulsion, which dictates its behavior and affects the interaction between the liquid emulsion and the particles, and the interaction between the liquid emulsion and the surface to be treated in polishing processes.

One effect of the surfactant in this invention is to control the interaction of the dispersed polar phase with the conductive liquid bridges between particles, indirectly controlling the conductivity. The surfactant controls the stability of the dispersed polar phase in the continuous non-polar phase, the lower the stability, the greater the interaction with the conductive liquid bridges.

Furthermore, an additional effect is that the surfactant can form a layer on the surface of the metal piece in electropolishing processes. This acts as a protector and leveler of the surface, since in the roughness valleys the layer is more stable, favoring a greater exposure of the roughness peaks, which results in smoother finishes when using this invention.

The surfactant controls the availability of the dispersed polar phase to intervene in the conductive liquid bridges.

The greater the restriction of the dispersed polar phase in the emulsions, the slower the electrolytic medium, there is less attack on the surface to be treated, and better finishes are produced. Greater restriction is achieved with emulsifiers that effectively stabilize the dispersed polar phase in the continuous non-polar phase. Low HLB surfactants favor this restriction.

Electrolytic media with less restriction of the discontinuous polar phase favor higher conductivity. This conductivity makes the system more aggressive and also faster, favoring the removal of material. This type of system is especially focused on metals that are self-passivating, such as stainless steels, titanium, aluminum, among others. Surfactants that do not stabilize especially polar emulsions in non-polar phases are indicated in this case, that is, with high HLB, making the emulsion less stable and facilitating a greater amount of aqueous bridges.

To obtain a versatile electrolyte, it is interesting to use a mixture of surfactants with different properties. Using a combination of nonionic surfactants (relatively low HLB) with anionic surfactants (with higher HLB), a system capable of working under a wide range of conditions and providing good results is achieved.

This combination can be, for example, without limiting purpose, a nonionic surfactant with an ethoxylated chain attached and an anionic surfactant with a sulfonic or carboxyl group (s).

Surfactants comprise at least one polar head and one non-polar tail. According to the polar head, we can refer to cationic, anionic, zwitterionic, or neutral surfactants. All of them can be used in this process.

The non-polar tail can include an aliphatic chain of formula $C_nH_{2n+1}$ that is straight or branched. Preferably it includes a linear aliphatic chain. Even more preferably this chain is in the $C_6$-$C_1$ range.

The non-polar tail can also include aromatic groups. Furthermore, it can also include a combination of both in which the aliphatic chain is linked to an aromatic ring and this in turn is linked to the polar group.

Anionic surfactants have the advantage of not interacting with sulfonic or carboxylic functional groups, for which reason they are preferably used when the polymeric material includes these functional groups. Anionic surfactants comprise at least one polar head consisting of a negatively charged functional group, a non-polar chain, and a cation. Preferably, the negatively charged polar group comprises a sulfate, sulfonate, phosphate or carboxylate group.

Examples of anionic surfactants include, but are not limited to, alkylbenzene sulfonates, lignin sulfonates, alkyl sulfates, alkyl ether sulfates, docusate, perfluoroactonosulfonate, perfluorobutanesulfonate, alkyl aryl ether phosphate, alkyl ether phosphate, alkyl carboxylates, among many others.

The cationic surfactants being preferably used are based on nitrogen-containing groups, such as amino, ammonium, alkanolamine, or pyridinium. These surfactants include primary, secondary, or tertiary amines with alkyl or aryl groups.

The neutral surfactants being preferably used are those that include polyether chains as their polar part, since these chains are more voluminous than the ionic groups and favor a good stability of the water-in-oil emulsion. For example, chains with ethylene glycol units, alkylphenol ethoxylates, fatty alcohols, amides, sorbitan derivatives, among others.

Zwitterionic surfactants, also called amphoteric surfactants, simultaneously have a cation and an anion in the same molecule, as well as a hydrophobic tail. Non-limiting examples of groups present in zwitterionic surfactants that can be used in this process include alkyl amine oxides, betaines, sultaine, phosphocholine group, among others.

Ratio of "Non-Conductive Fluid" to "Solid Electrolyte Particles"

The amount of non-conductive fluid must be sufficient to coat the surface of the set of sphere particles and the pieces to be polished. If the ratio of non-conductive fluid is too low, the desired effects are not achieved in the process. The minimum value of non-conductive fluid to carry out the process is 0.05% of non-conductive fluid with respect to the total electrolytic medium.

Preferably, the mass percentage of solid electrolyte particles is between 20% and 99% with respect to the total mass which is represented by solid electrolyte particles plus non-conductive fluid, more preferably between 50% and 80%.

A conceptually interesting point is the quantity that fills the interstitial spaces of the set of solid electrolyte particles. The formulation can have more or less quantity than this value. A higher quantity facilitates pumping and fluidity of the medium.

Depending on the ratio of the non-conductive fluid with respect to the solid electrolyte particles, the physical properties of the set vary significantly, this affects the fluidity, but also the conductivity. Two extreme exemplary cases are described below: granular material type and fluid type.

Granular Material

This first type includes those embodiments in which the amount of non-conductive fluid is not sufficient for the electrolyte of this invention to have free liquid. The non-conductive liquid is distributed on the surface of the spheres.

This ratio of conductive fluid is usually below 10% by weight of the non-conductive liquid with respect to the total electrolytic medium so that there is no free liquid, and above 0.05% so that there is an appreciable effect. In this conformation, the electrolytic medium behaves like a granular material. Its mobility can be promoted and controlled by vibrating systems or fluidization by injection of a gas, such as air.

In these quantities, the non-conductive fluid is distributed over the surface of the solid electrolyte particles without any free liquid being observed. It is especially located in the less polar areas, which are those that are in contact with the air. In the areas of the surface of each particle that contact other particles, here mainly there is less non-conductive fluid and more electrolyte liquid. In this way, hydrophilic bridges are established between the particles that act as cohesive forces between the particles. To achieve this distribution it is necessary that the electrolyte liquid and the non-conductive fluid be immiscible.

Conductivity through the particles occurs through these hydrophilic bridges.

Fluid

When the amount of non-conductive fluid exceeds the interstitial volume between the solid electrolyte particles, the excess liquid becomes the supernatant. The interesting thing about this type of formulations is that, when being removed, the particles are in suspension in the non-conductive fluid, while the existence of the cohesive force of the hydrophilic bridges keeps the particles in contact, which maintains conductivity. In this state, we have a whole that behaves like a conductive fluid, allowing it to be transported and pumped like a fluid.

When the electrolytic medium is at rest, particles settle, leaving the liquid distributed between the interstices and the supernatant.

When the electrolytic medium is moving, it becomes homogenized, keeping the particles in suspension, and the whole behaves like a fluid as long as the movement is maintained.

This formulation has the advantage of being able to handle the set as a fluid, which allows it to be blasted towards the areas to be polished that require it most or are difficult to access. This is a great advantage as it allows the process to attack areas and recesses that would not otherwise be well processed. Non-conductive fluids based on emulsions are especially useful for these applications, since they have greater fluidity and conductivity. In this case, it is possible to work under conditions in which the moving liquid behaves like an organic phase with aqueous micelles, but in a state of rest there is a separation of the organic phase and the aqueous phase.

These systems also allow the use of ultrasound simultaneously with the electropolishing process to help the surface cleaning process.

If connectivity is lost due to excess liquid and movement, which is a common problem in projection systems, a partial liquid separation process can be incorporated to ensure particle contact. For example, it can be pumped using excess non-conductive liquid and remove excess non-conductive liquid before projecting the medium onto the piece.

Electropolishing Process

The electrolytic medium described is specially designed to be used in an electropolishing process for metal pieces.

In this process, an electric current is applied between the piece and a cathode through the electrolytic medium described. This generates redox processes on the metal surface, which generate oxides and salts at the roughness peaks. Solid electrolyte particles dissolve or remove these oxides and salts, removing material from roughness peaks, producing a smoothing effect on the surface.

Therefore, the electropolishing process comprises the steps of:

a) connecting at least one piece to be polished to a power supply;

b) connecting at least one electrode to the opposite pole of the power supply;

c) contacting the piece to be polished and the solid electrolyte particles of the electrolytic medium defined above with a relative movement between the piece and the particles;

d) applying a potential difference between the piece to be polished and the electrode, which produces a current flow between them through the defined electrolytic medium.

The minimum elements to carry out this process are:

Electrolytic medium comprising a set of solid electrolyte particles and a non-conductive fluid A metal piece to be polished A power supply An electrode A mechanism that causes a relative movement of the piece vs. the particles in the medium.

Therefore, a final aspect of the invention refers to a electropolishing device comprising:

a power supply (1);

an electrode (3) capable of transmitting the electrical charge from the power supply to the electrolytic medium;

means for generating relative movement between at least one metal piece (2) to be polished and an electrolytic medium as defined above selected from:

means, connected to the power supply (1), for blasting the electrolytic medium on the piece (2) and a cage (14) with the means of movement where the piece (2) and the electrolytic medium are located, cage (14) that provides the piece (2) with electrical connectivity and a container that contains the electrolytic medium and an electrode (3) and a system that provides the piece with movement and electrical connectivity with the power supply.

The power supply (1) is connected to the piece (2) to be polished and to the electrode (3). A mechanism produces a relative movement between the piece (2) to be polished and the electrolytic medium. The power supply provides a potential difference between the piece (2) to be polished and the electrode (3). The current that circulates between the piece (2) and the electrode (3) produces oxidation effects in the piece that transform the surface metal into oxides or salts. Solid electrolyte particles when in contact with oxidized metal dissolve or remove it from the surface. When the particles are spherical they can only contact the roughness peaks, only at these points oxidation occurs and only at these peaks metal is removed. In this way, the roughness is reduced by the removal of metal from the roughness peaks.

Applied Current

The power supply (1) provides a potential difference between the piece (2) to be polished and the electrode (3). In a general way, the piece is connected to the positive pole or anode, and the negative pole is connected to the electrode.

The applied current can be controlled in an amperiostatic mode or in a potentiostatic mode.

The applied voltage depends on experimental parameters that vary in each case: metal to be polished, exposed metal surface, conductivity of the electrolytic medium, among others.

In metals and geometries in which there is an accumulation of metal oxides and salts, in these cases, it is advisable to apply polarity reversal intervals. These polarity reversals can occur in the order of seconds, milliseconds, or microseconds. Each metal, depending on its characteristics and those of the salts and oxides it produces, requires optimized polarity reversal times. For example, for electropolishing titanium, polarity reversal ranges on the order of tens of microseconds will preferably be applied. The reversal of polarity can be in a symmetric way, that is, using the same voltage, or in an asymmetric way, that is, the positive voltage different from the negative one, which allows better adaptation to each phase.

It is also possible to use pause times in which no current flows, in which there is still a relative movement of the particles vs. the piece to be polished, to allow time for the dissolving process.

Preferably an electric current divided into four sections is applied: Direct-Pause 1-Reverse-Pause 2. Each section with a time that can be regulated independently, so that it can be adapted to each case. The duration of each section can be in the order of seconds, milliseconds, or microseconds.

The pauses of electric current is useful to give the electrolytic medium time to dissolve the oxides formed during the direct current step.

In an empirical way and not predictable a priori, it has been observed that electropolishing processes that include polarity reversals of the order of microseconds, from 1 to 1000 microseconds, provide final finishes with a lower roughness and a higher gloss. This is probably due to the fact that the oxide layers generated by the direct current are less thick and are more easily removable in the reverse step and the pauses.

Movement

A key aspect of the process is the relative movement of the solid electrolyte particles and the piece to be polished. This can be achieved in different ways, which will affect the formulation of the electrolytes used, as well as the machinery necessary to carry out this process.

Relative Movement of the Piece Vs. Solid Electrolyte Particles

The relative movement between the pieces and the solid electrolyte particles is a characteristic need or limitation of this invention that is not found in conventional electropolishing in liquid.

Relative movement between pieces and particles can be achieved in a number of different ways. Two possibilities are explained below, without this implying any limitation to other possible conformations. Each movement takes advantage of the benefits of the different possible formulations of the electrolyte.

The exemplary modes of relative movement are:

Movement of the piece in the electrolytic medium

Blasting of the electrolytic medium on the piece

Both modes can occur with both granular material and fluid medium.

Movement of the Piece in Electrolytic Medium

In the strategy of moving the piece in an electrolytic medium, this relative movement consists of moving the piece in a container that contains the particles. In this way, there is a contact of the piece with the particles that causes a friction force. This movement can be macroscopic, that is, a translational movement, or it can be a millimeter or sub-millimeter vibration movement. Vibration is preferably applied in all cases, since it improves local movement without negative effects being observed.

The optimal macroscopic movement to apply depends on the geometry of the piece. For example, for pieces with cylindrical geometry, such as drills, punches, bars, etc. preferably a horizontal circular translational movement is applied, which may additionally be accompanied by a vertical oscillatory movement.

When used with granular material, solid electrolyte particles are used with a relatively low amount of non-conductive fluid, less than 10% by weight of the whole electrolyte medium. This results in a formulation in which, for the most part, no free liquid is observed. The presence of non-conductive fluid acts as a lubricant, improving the mobility of the particles and preventing them from getting caught on the surface to be polished due to hydrophilic effects. This extra mobility is an advantage over systems without non-conductive fluid, since it allows polishing delicate pieces without the resistance of the medium damaging them.

In other conformations, the piece moves in an electrolytic medium that behaves like a fluid due to a movement of the solid electrolyte particles in the non-conductive fluid. The amount of non-conductive fluid is around the volume necessary to cover the interstitial spaces of the particles, but it can be higher or lower. Preferably, the volume of the non-conductive fluid is greater than that necessary to cover the interstitial spaces.

The movement to keep the particles in suspension can be achieved by stirring, by insufflating a gas, by means of a drum, etc.

Blasting of the Electrolytic Medium on the Piece

In this strategy, the relative piece-medium movement is achieved by blasting the electrolytic medium in the form of a jet against the surface of the metal piece to be polished.

It is possible to use this system with the granular medium. In this case, the particles must maintain some contact with each other. This can be achieved by the syncopated impulse of the granular material.

However, this system is much more viable taking advantage of the properties of fluid type formulations. In these cases, it is possible to pump it and blast it against the surface of the piece to be polished, as if it were a hose. The end of a blasting nozzle acts as a cathode. The electrolytic medium is blasted on the piece to be polished, a potential difference is applied between the piece and the nozzle, which causes a current between the piece and the cathode-nozzle through the solid electrolyte particles of the jet. The electrolytic medium falls into a container and can be pumped out again.

This system requires constant agitation to maintain fluidity. This agitation can be achieved by different means, such as stirring the medium, applying a bubbling gas injection, etc.

As it has been said, the electropolishing process that uses the electrolytic medium composed of solid electrolyte particles with a non-conductive fluid requires devices that are adapted to the specificities of this new medium.

These devices must include, as a minimum:

a power supply (1);

an electrode (3) capable of transmitting the electrical charge from the power supply to the electrolytic medium;

means for generating relative movement between at least one metal piece (2) to be polished and an electrolytic medium as defined above, selected from: means, connected to the power source (1), for blasting the electrolytic medium on the piece (2); and a cage (14) with the means of movement where the piece (2) and the electrolytic medium are located, cage (14) that provides the piece (2) with electrical connectivity;

a container containing the electrolytic medium and an electrode (3) and a system that provides the piece with movement and electrical connectivity with the power supply.

The power supply provides enough voltage to produce electrolytic effects on the piece. The applied voltage can be direct, alternating, rectified alternating, pulsed, square wave, etc. Preferably, the power supply is capable of providing a current that includes polarity reversals. Reversals of polarity can occur at frequencies with a period in the order of seconds, milliseconds, or microseconds. In an empirical way and not predictable a priori, it has been observed that electropolishing processes that include polarity reversals of the order of microseconds, from 1 to 1000 microseconds, provide final finishes with a lower roughness and a higher gloss A fundamental part of the process is the relative movement between the piece to be polished and the electrolytic medium. Different systems are envisaged for this purpose, each one adapted to different needs, either by size, shape, type of piece, number of pieces to be polished at the same time, among other parameters.

In a preferred embodiment, the means for generating relative movement consist of a system capable of moving the piece to be polished immersed in the electrolytic medium. This system has the advantage that the entire piece to be polished is in contact with the electrolytic medium, so the entire piece is processed at the same time. A preferred movement of the piece in the medium is that of circular translation. This movement is optimal since it causes a pressure zone in all orientations, so that there are no orientations that receive more pressure than others. Alternatively or in addition, an alternately up-down vertical movement can be used that generates a relative movement in that direction. The choice of movement to apply will depend on the geometry of the part to be processed.

In this system, the pieces to be polished can have a firm clamping that ensures permanent electrical contact and proper orientation. This clamping is suitable for pieces with high added value, complicated geometries or delicate details.

Alternatively, in this system the pieces are not firmly held but are placed in a compartment that allows the electrolytic medium with its particles to pass through, but does not allow the pieces to be polished to come out. This compartment has a network or a perforated metal plate that is connected to the power supply, the pieces when contacting this network are provided with electrical connectivity through the power supply. This device is called a cage device.

Figure 3:
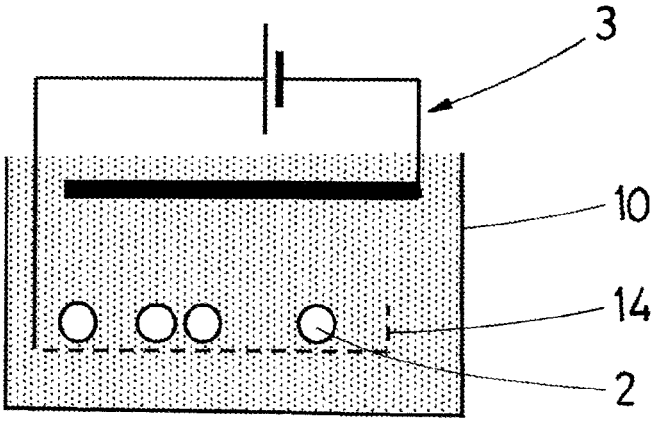
FIG. 3 shows a schematic view of a device of the invention in which the pieces to be polished are not firmly held, but rather are in a compartment that provides them with electrical connectivity.

FIG. 3 shows a schematic view of a cage device for electropolishing in which the pieces to be polished are not firmly held, but are instead in a container that provides them with electrical connectivity. The pieces to be polished are located in a container whose limits allow the passage of solid electrolyte particles, but do not let the pieces to be polished escape. Part of the container that contacts the pieces to be polished is made of a conductive material, and connects the electrical source with the pieces, so that they receive electrical connectivity without being permanently fixed.

Preferably, the pieces may be resting on a conductive grid that is connected to the power supply.

This device causes a relative movement of the pieces to be polished with respect to the solid electrolyte particles. For example, this effect can be achieved by moving the container of the pieces to be polished in the electrolytic medium, which produces a relative movement between the particles and the pieces to be polished. Alternatively, there may be a system that causes a flow of solid electrolyte particles through the container.

In another preferred embodiment, the means for generating relative movement between the piece to be polished and the electrolytic medium comprise a system that drives the electrolytic medium over the piece in the form of a jet. Within this jet, the solid electrolyte particles must maintain connectivity between them. This system has the advantage of being able to process the pieces in sections and reach internal areas that are difficult to access. In addition, this system can be applied for polishing in the cabin. In this system, a jet of electrolytic medium comes out of a nozzle that is connected to the power supply and acts as an electrode. The jet contacts the piece to be polished and falls into a collection container. This container keeps the solid electrolyte particles in suspension by stirring, sparging or other system. A pumping system, such as a peristaltic pump, pushes the medium back towards the piece.

Figure 4:
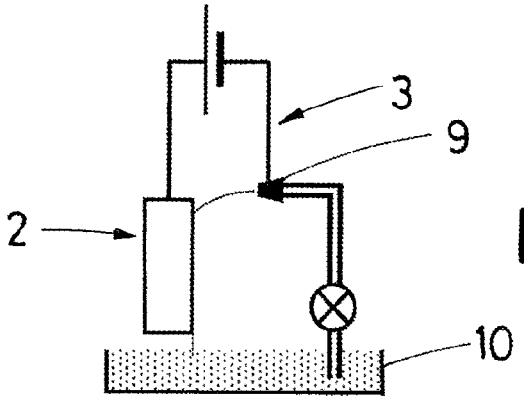
FIG. 4 shows a schematic view of a device of the invention in which the electrolytic medium is blasted towards the piece to be polished receiving electrical connectivity from the outlet nozzle connected to the cathode.

FIG. 4 shows a schematic representation of this device for an electropolishing process using an electrolytic medium with a non-conductive fluid that causes the relative movement of the solid electrolyte particles with respect to the piece to be polished through blasting a jet of the electrolytic medium, by means of a nozzle (9).

The device comprises a power supply, a system for providing electrical connectivity to the piece to be polished, a system for driving the electrolytic medium and an electrode with polarity opposite to the piece to be polished at the outlet of the jet of electrolytic medium.

This system benefits from the advantages provided by a liquid-type electrolytic medium, since this medium can be pumped and propelled towards the piece to be polished and have an impact on difficult-to-polish areas.

Therefore, preferably the device comprises a nozzle (9) as a blasting means attached to the cathode (3). More preferably it further comprises a pump for pumping the electrolytic medium that falls into the container (10) towards the nozzle (9).

In general, the projected particles tend to lose contact with each other, which limits the electrical conductivity. In this invention, this limitation is especially overcome with the formulations of electrolytic medium with solid electrolyte particles with emulsion since, in this case, the dispersed polar phase reinforces the conductive liquid bridges that are established between particles, improving the electrical conductivity of the system, making it a novel solution to how to maintain electrical connectivity between blasted conductive particles.

In another preferred embodiment, the means for generating a relative movement between the piece to be polished and the electrolytic medium comprise a system formed by a drum that has openings of a size such that it is capable of letting the solid electrolyte particles of the electrolytic medium pass, but retains the pieces to be polished. The drum can rotate fully or partially, causing parts to flip so that they are processed in all orientations. The drum can be cylindrical or be a prism with a triangular, square, hexagonal section, among others.

This drum has an element connected to the power supply that contacts the pieces to be polished. This element can be part of the walls of the drum, or it can be a flexible element directed towards the interior of the drum that contacts the pieces. This embodiment is especially useful for processing pieces in large quantities.

Figure 5:
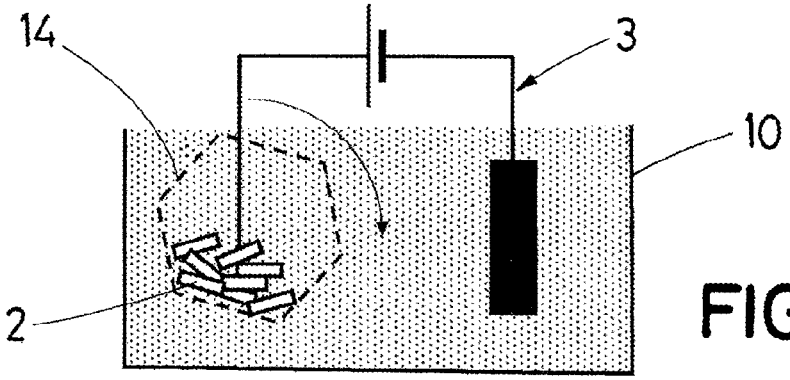
FIG. 5 shows a device of the invention in which the multiple pieces to be polished are located in a drum with the ability to rotate.

FIG. 5 shows a diagram of the device for electropolishing by means of a solid electrolyte with non-conductive fluid in which the multiple pieces (2) to be polished are located in a cage (14) with the ability to rotate. This device comprises a power supply (1), an electrode (in black), a cage (14) with walls that allow the passage of the electrolytic medium (hexagon).

This system allows the treatment of multiple pieces (2) at the same time, which is indicated for industrial series. A key point of this device is the container cage (14). The walls of the cage (14) must keep the pieces inside, but allow the free circulation of the solid electrolyte particles through them. As preferably the solid electrolyte particles are spheres of a size between 0.1 and 1 mm, there should be openings in the walls of preferably more than 4 mm. For this reason, this device is not suitable for pieces that are smaller than that size.

In another preferred embodiment, the movement is generated by a global movement of the system. In this embodiment, the electrolytic medium, the electrode and the piece to be polished are located in a closed container. The piece to be polished is firmly attached, as well as the electrode. An external mechanism causes a movement sufficient to produce a global movement of all the medium contained within. For example, this movement can be a "shaker" type, a sudden shaking. Likewise, this movement can be a repeated lying down in one or more axes, such as a gyroscopic mixer type movement.

Exemplary Embodiments

Formulation of an Electrolytic Medium Type Granular Material with Methanesulfonic Acid In a preferred embodiment, the polymer particles are ion exchange resin based on a macroporous sulfonated divinylbenzene S-DVB and styrene copolymer with a tending to spherical shape with a size distribution centered around 0.7 mm, under the trade name Mitsubishi Relite CFS.

These particles contain 40% by weight of a conductive solution consisting of a 10% methanesulfonic acid solution in distilled water. 0.3% by weight of a mixture of low viscosity $C_0$-$C_{16}$ hydrocarbons, under the trade name HYDROSEAL G 232 H, has been added to these particles.

Preferred compositions are shown in Table 1 and Table 2.

Table 1: Shows a Preferred Composition of the Electrolytic Medium of the Invention

| Element | Composition | % by mass |
|---|---|---|
| Non-conductive fluid | Hydroseal G 232 H | 0.3 |
| Polymeric particle | Mitsubishi Relite CFS | 59.8 |
| Conductive solution | 10% Methanesulfonic acid | 39.9 |

Table 2: Shows a Preferred Composition of the Electrolytic Medium of the Invention with Ranges:

| | | % by mass | |
|---|---|---|---|
| Element | Composition | Minimum | Maximum |
| Non-conductive fluid | Hydroseal G 232 H | 0.05 | 15 |
| Polymeric particle | Mitsubishi Relite CFS | 35 | 70 |
| Conductive solution | Methanesulfonic acid * | 20 | 50 |

* The concentration of methanesulfonic acid is preferably in a range of 1 to 45% by mass.

Formulation of a Granular Material Type Electrolytic Medium with Sulfuric Acid

In this embodiment, the solid electrolyte with non-conductive fluid is composed of a set of solid electrolyte particles based on spherical polymer particles of sulfonated divinylbenzene-styrene ion exchange resin with a gel-like structure, without defined porosity, with a mean diameter about 0.7 mm, Mitsubishi Relite CFH.

The polymer particles contain 45% of a 5% sulfuric acid conductive solution in water. As a non-conductive fluid, Hydroseal G 232 H or a polydimethylsiloxane-based silicone oil with a viscosity of $3 \cdot 10^{-6}$ $m^2/s$ (3 cSt) at 3% is used.

This formulation controls many acid exudates, which if used in a solid electrolyte electropolishing process results in a final surface obtained with specular finishes. This formulation controls many acid exudates, which if used in a solid electrolyte electropolishing process results in a final surface obtained with specular finishes.

Table 3: Shows a Preferred Composition of the Electrolytic Medium of the Invention

| Element | Composition | % by mass |
|---|---|---|
| Non-conductive fluid | Hydroseal G 232 H | 3.0 |
| Polymeric particle | Mitsubishi Relite CFH | 52.0 |
| Conductive solution | 5% Sulfuric acid | 45.0 |

Table 4: Shows a Preferred Composition of the Electrolytic Medium of the Invention

| | | % by mass | |
|---|---|---|---|
| Element | Composition | Minimum | Maximum |
| Non-conductive fluid | Hydroseal G 232 H | 1 | 15 |
| Polymeric particle | Mitsubishi Relite CFH | 35 | 70 |
| Conductive solution | Sulfuric acid * | 20 | 50 |

* The conductive solution is a sulfuric acid solution with a concentration of 0.5 to 30% by mass.

Table 5: Shows a Preferred Composition of the Electrolytic Medium of the Invention

| Element | Composition | % by mass |
|---|---|---|
| Non-conductive fluid | Polydimethylsiloxane | 3.0 |
| Polymeric particle | Mitsubishi Relite CFH | 52.0 |
| Conductive solution | 5% Sulfuric acid | 45.0 |

Table 6: Shows a Preferred Composition of the Electrolytic Medium of the Invention

| | | % by mass | |
|---|---|---|---|
| Element | Composition | Minimum | Maximum |
| Non-conductive fluid | Polydimethylsiloxane | 1 | 15 |
| Polymeric particle | Mitsubishi Relite CFH | 35 | 70 |
| Conductive solution | Sulfuric acid * | 20 | 50 |

Solid Electrolyte Particle with Non-Conductive Fluid

Another preferred embodiment of this invention consists of an ion exchange resin with acrylic acid units having spherical form with a gel-like structure, which reduces exudates in combination with an electrolytic aqueous solution containing 5% citric acid that provides the necessary conductivity.

As non-conductive fluid, a fluorinated solvent of low viscosity and high boiling point is used, in this case the fluorinated solvent is FC96500. This low viscosity solvent improves movement between the particles.

Fluid Electrolytic Medium Formulation with Methanesulfonic Acid

In a preferred embodiment, there is an amount of non-conductive fluid to fill the interstitial spaces of the particles at rest and an additional amount. When the particles are at rest, there is a non-conductive fluid part supernatant. When the set is moving, a homogeneous suspension of the solid electrolyte particles is obtained in the non-conductive fluid that as a whole conducts electricity.

In this preferred embodiment, the solid electrolyte is formed by a Mitsubishi Relite CFH ion exchange resin that contains as liquid electrolyte 45% by weight of a 10% methanesulfonic acid solution. On these electrolyte particles, a $C_9$-$C_{16}$ hydrocarbon-based non-conductive fluid is added, such as the commercial one called Hydroseal G 232 H to cover the entire volume of electrolyte particles (fill the interstitial spaces), and then a 10% more of the added volume.

Table 7: Shows a Preferred Composition of the Electrolytic Medium of the Invention

| Element | Composition | % by mass |
|---|---|---|
| Non-conductive fluid | Hydroseal G 232 H | 50 |
| Polymeric particle | Mitsubishi Relite CFS | 59.8 |
| Conductive solution | 10% Methanesulfonic acid | 39.9 |

Table 8: Shows a Preferred Composition of the Electrolytic Medium of the Invention

| | | % by mass | |
|---|---|---|---|
| Element | Composition | Minimum | Maximum |
| Non-conductive fluid | Hydroseal G 232 H | 15 | 60 |
| Polymeric particle | Mitsubishi Relite CFS | 30 | 65 |
| Conductive solution | Methanesulfonic acid * | 1 | 25 |

* The concentration of methanesulfonic acid is preferably in a range of 1 to 45% by mass.

Fluid-Type Electrolytic Medium Formulations with Emulsion

TABLE 9

Example of emulsified formula for stainless steels

| Element | Composition | % by mass |
|---|---|---|
| Non-conductive fluid | Hydroseal G 232 H | 24.5 |
| | Detergent A | 5.5 |
| Polymeric particle | Mitsubishi Relite CFH | 52.5 |
| Conductive solution | $H_2O$ | 12.5 |
| | MSA 70% | 5.0 |

TABLE 10

Example of emulsified formula for carbon steels

| Element | Composition | % by mass |
|---|---|---|
| Non-conductive fluid | Hydroseal G 232 H | 21.0 |
| | Detergent A | 4.8 |
| Polymeric particle | Mitsubishi Relite CFH | 63.0 |

TABLE 10-continued

Example of emulsified formula for carbon steels

| Element | Composition | % by mass |
|---|---|---|
| Conductive solution | $H_2O$ | 8.7 |
| | 98% Sulfuric acid | 1.7 |
| | 85% Phosphoric acid | 0.8 |

TABLE 11

Exemplary general range of emulsified formulations

| | | % by mass | |
|---|---|---|---|
| Element | Composition | Minimum | Maximum |
| Non-conductive fluid | Hydroseal G 232 H | 10 | 60 |
| | Surfactants | 0.5 | 10 |
| Polymeric particle | Mitsubishi Relite CFH | 30 | 80 |
| Conductive solution | $H_2O$ | 10 | 25 |
| | 98% Sulfuric acid* | 0 | 15 |
| | 85% Phosphoric acid* | 0 | 15 |
| | 70% Methanesulfonic acid* | 0 | 15 |

*The sum of the three acids is greater than 0.5%

Next, Tables 12 to 14 of the Detergent A cited in the previous tables are shown.

TABLE 12

Exemplary formula of detergent A, A1

| Element | Composition | % by mass |
|---|---|---|
| Detergent A | Dodecylbenzenesulfonic acid | 2.275 |
| | C10.9M Ethoxylated Alcohol | 1.250 |
| | Triethanolamine | 0.900 |
| | Coconut diethanolamide | 0.500 |
| | 50% KOH solution | 0.275 |
| | $H_2O$ | 94.800 |

TABLE 13

Exemplary formula of detergent A, A2

| Element | Composition | % by mass |
|---|---|---|
| Detergent A | Dodecylbenzenesulfonic acid | 2.250 |
| | C10.9M Ethoxylated Alcohol | 1.250 |
| | Coconut diethanolamide | 0.500 |
| | $H_2O$ | 96.000 |

TABLE 14

Exemplary formula of detergent A in range:

| | | % by mass | |
|---|---|---|---|
| Element | Composition | Minimum | Maximum |
| Detergent A | Dodecylbenzenesulfonic acid | 0.5 | 10 |
| | C10.9M Ethoxylated Alcohol | 0 | 10 |
| | Coconut diethanolamide | 0 | 10 |
| | $H_2O$ | c.s.p. | 99.5 |

Part Movement Device in Electrolytic Medium with Firm Clamping

This prototype device is designed to treat gears and pinions of different sizes. For this application, the suitable electrolytic medium is the "emulsified formula for carbon steels".

It has a power supply (1) that connects the positive pole with the piece to be polished (2) and the negative pole with the cathode (3).

The power supply (1) is capable of supplying a pulsed and polarity reversal current, with or without pauses between the different polarities. The pulses can be of high frequency, being able to have a duration in the order of microseconds to seconds. It is capable of applying asymmetric voltages, that is, applying a different voltage value to each polarity.

The piece to be polished (2) is held by a holder (4). This holder has the function of holding the piece during the process and providing it with the electrical connection with the power supply. Likewise, it can incorporate a vibrator system to improve the relative movement of the piece-electrolytic medium.

The holder (4) is connected to a system that provides a movement of the piece or pieces that it holds with the medium. This movement system in this embodiment consists of a guide-shaft (5) actuated by a pneumatic piston (6) that provides a vertical oscillatory movement in rhythm with a rotation so that the movement produced coincides with the inclination of the teeth of the pinion o gear to be polished. In this way there is a fluid movement of the particles through the interstitial space.

The fluid movement of the particles in the interstitial space is achieved by means of the vibrator of the holder (4), the movement provided by the guide (5) and the pneumatic piston (6) and the injection of air into the bottom of the electrolytic medium by means of a compressor (7).

All the machinery of the process is integrated into a structure (8) that stiffens the entire system to avoid unwanted movements between the electrolytic medium and the piece to be polished.

(1) Power supply
(2) Piece to be polished
(3) Cathode
(4) Holder
(5) Guide-shaft
(6) Pneumatic piston
(7) Compressor
(8) Structure Device for Blasting the Electrolytic Medium on the Piece This device is designed for a process in which a fluid-type electrolytic medium of the invention is blasted onto the surface to be polished. Any electrolytic medium of the invention can be used, but the best results are obtained with an electrolytic medium with an emulsified formulation.

Figure 2:
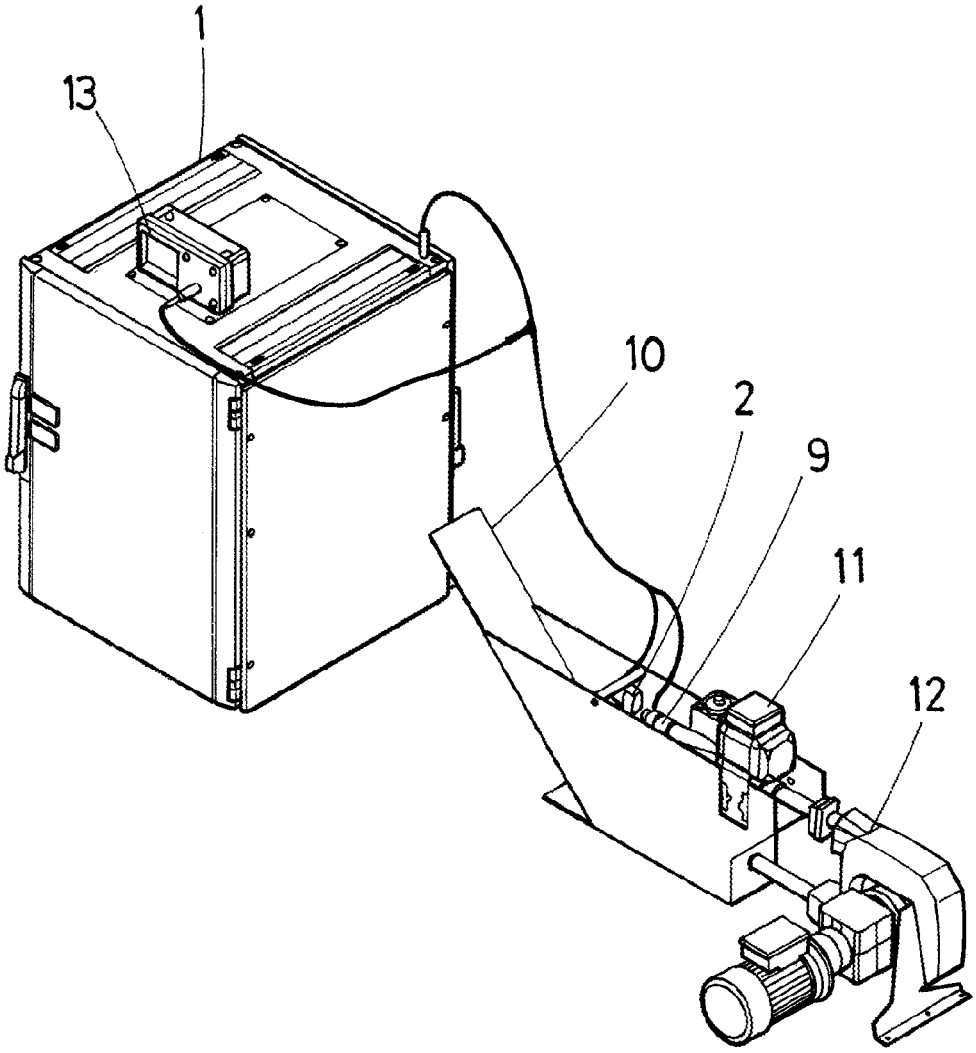
FIG. 2 shows an exemplary diagram of an electropolishing device of the invention by blasting.

A schematic example of this type of device can be seen in FIG. 2.

A power supply (1) connects the positive pole to the piece to be polished (2) and the negative pole to a cathode-nozzle (9).

The power supply (1) is capable of supplying a pulsed and polarity reversal current, with or without pauses between the different polarities. The pulses can be of high frequency, being able to have a duration in the order of microseconds to seconds. It is capable of applying asymmetric voltages, that is, applying a different voltage value to each polarity.

This device produces a jet of the electrolytic medium that comes out through the cathode-nozzle (9), which has the functions of directing the jet towards the piece and operating as electrical contact with the electrolytic medium.

After contacting the piece, the electrolytic medium is collected in a tank (10).

In this tank there is a medium stirrer (11) that keeps the solid electrolyte particles in suspension in the electrolytic medium. Alternatively or in addition, the medium can be kept in suspension by bubbling a gas such as air.

A peristaltic pump (12) drives the electrolytic medium with sufficient pressure from the tank (10) to the cathode-nozzle (9). Alternatively, the impulse of the electrolytic medium from the tank (10) to (9) can be produced by other means such as suction, an endless screw, pistons, etc.

The device preferably includes a system for analyzing the electric current that is actually passing through the system, such as an oscilloscope (13).

(1) Power supply
(2) Piece to be polished
(9) Cathode-nozzle
(10) Tank
(11) Stirrer
(12) Peristaltic pump
(13) Oscilloscope Example of a Blasting Polishing Process In this exemplary case, the piece to be polished is a 25 $cm^2$ flat stainless steel surface. The movement is achieved by projecting the electrolytic medium on the surface to be polished. The electrolytic medium has the following composition:

TABLE 15

Composition of the electrolytic medium

| Element | Composition | % by mass |
|---|---|---|
| Non-conductive fluid | Hydroseal G 232 H | 24.5 |
| | Detergent A1 | 5.5 |
| Polymeric particle | Mitsubishi Relite CFH | 52.5 |
| Conductive solution | $H_2O$ | 12.5 |
| | 70% MSA | 5.0 |

The distance between the jet outlet nozzle and the piece is 3 cm. The jet covers the entire surface of the piece.

A current divided into four sections is applied between them: Direct-Pause 1-Reverse-Pause 2. Direct phase is the one that applies the positive voltage to the piece, reverse phase applies the negative, and pauses do not apply electrical voltage.

A symmetrical 35 V potential difference is applied, with a duration of each section of 2-0.1-3-0.1 in milliseconds.

These conditions are applied for 35 minutes to produce a reduction in $R_a$ from 2.1 μm to 0.5 μm.

The invention claimed is:

1. An electropolishing medium comprising:
a set of solid-particles that each retains a conductive solution; and
a non-conductive liquid occupying an interstitial space between the solid particles, the conductive solution having an affinity to be kept inside the set of solid particles and the non-conductive liquid being outside the solid particles.

2. The electropolishing medium according to claim 1, wherein the non-conductive liquid is immiscible in the conductive solution.

3. The electropolishing medium according to claim 1, wherein each of the solid particles comprises pores in which the conductive solution is retained.

4. The electropolishing medium according to claim 3, wherein each of the solid particles is composed of an ion exchange resin that comprises a polymeric material.

5. The electropolishing medium according to claim 4, wherein the polymeric material is formulated with a monomer selected from the group consisting of: styrene, divinylbenzene, acrylic acid, monomer derived from acrylic acid, methacrylic acid, and monomer derived from methacrylic acid.

6. The electropolishing medium according to claim 4, wherein the polymeric material includes functional groups selected from the group consisting of: sulfonic acid, carboxylate, iminodiacetic acid, aminophosphonic acid, polyamine, 2-picolylamine, thiourea, amidoxime, isothiouronium and bispicolilamine.

7. The electropolishing medium according to claim 1, wherein the conductive solution is selected from the group consisting of: an aqueous solution and an aqueous solution comprising an acid selected from the group consisting of: sulfuric acid, sulfonic acids, methanesulfonic acid, hydrochloric acid and phosphoric acid.

8. The electropolishing medium according to claim 1, wherein the non-conductive liquid comprises a fluid selected from the group consisting of: hydrocarbons with five to sixteen carbons, silicones, silicone oils and fluorinated solvents.

9. The electropolishing medium according to claim 1, wherein the non-conductive liquid is an emulsion comprising:

a non-conductive fluid selected from the group consisting of hydrocarbons, silicones and fluorinated-solvents; and a conductive liquid.

10. The electropolishing medium according to claim 9, wherein the emulsion further comprises a surfactant.

11. The electropolishing medium according to claim 10, wherein the surfactant comprises a nonionic surfactant and an anionic surfactant and the conductive liquid is an aqueous solution with acidic pH.

12. The electropolishing medium according to claim 9, wherein the conductivity of the emulsion is lower than the conductivity of the solid particles.

13. The electropolishing medium according to claim 1, wherein each of the solid particles comprises a gel-like structure.

14. The electropolishing medium according to claim 1, wherein the non-conductive liquid partially occupies the interstitial space between the solid particles.

15. The electropolishing medium according to claim 1, wherein the non-conductive liquid fully occupies the interstitial spaces between the solid particles.

16. The electropolishing medium according to claim 1, wherein at least a portion of the non-conductive liquid covers at least a portion of the conductive solution retained in the solid particles.

17. The electropolishing medium according to claim 1, wherein the conductive solution comprises at least one acid.

18. The electropolishing medium according to claim 1, wherein the non-conductive liquid has a boiling point of greater than 100° C.

19. The electropolishing medium according to claim 1, wherein the non-conductive liquid has a viscosity in the range of $1\times10^{-7}$ $m^2/s$ and $1\times10^{-4}$ $m^2/s$.

20. The electropolishing medium according to claim 1, wherein the solid particles are in suspension in the non-conductive liquid.

21. The electropolishing medium according to claim 1, wherein the solid particles that retain the conductive solution have an electrical conductivity greater than 10 micronS/cm.

22. The electropolishing medium according to claim 2, wherein the non-conductive liquid and conductive solution do not form a single phase in any proportion between them at a temperature of 0 to 100° C.

23. The electropolishing medium according to claim 1, wherein the conductive solution is an aqueous solution.

24. The electropolishing medium according to claim 9, wherein the conductive liquid is the same as the conductive solution that is retained by the solid particles.

25. The electropolishing medium according to claim 1, wherein the conductive solution is selected from the group consisting of: an ionic liquid, a liquid acid, and a conductive liquid polymer.

26. The electropolishing medium according to claim 25, wherein the conductive solution includes a polar solvent.

27. The electropolishing medium according to claim 26, wherein the polar solvent is selected from the group consisting of: water, ethanol, isopropanol, DMSO, DMF and ionic liquids.

* * * * *